United States Patent [19]

Whisnant

[11] Patent Number: 4,545,142

[45] Date of Patent: Oct. 8, 1985

[54] DISPLAY FRAMING APPARATUS

[76] Inventor: Hubert E. Whisnant, 617 E. 28th St., Charlotte, N.C. 28205

[21] Appl. No.: 567,768

[22] Filed: Jan. 3, 1984

[51] Int. Cl.[4] ..... G09F 7/00

[52] U.S. Cl. ..... 40/605; 403/231

[58] Field of Search ..... 40/605, 155; 52/127.6, 52/127.7, 127.8, 127.11, 127.12, 239; 292/5, 30, 53; 70/103; 403/231; 160/135

[56] References Cited

U.S. PATENT DOCUMENTS

| | | | |
|---|---|---|---|
| 3,154,870 | 11/1964 | Hopp et al. | 40/605 |
| 3,466,777 | 9/1969 | Wistrand et al. | 40/605 |
| 3,811,785 | 5/1974 | Hagglund | 403/231 |
| 3,967,477 | 7/1976 | Harrington et al. | 292/5 |
| 4,239,268 | 12/1980 | Rider | 292/5 |

*Primary Examiner*—Robert P. Swiatek
*Assistant Examiner*—Cary E. Stone
*Attorney, Agent, or Firm*—Shefte Pinckney & Sawyer

[57] ABSTRACT

An improved display framing apparatus including panel frame members for bordering individual display panels and connecting frame members for joining panel assemblies as a booth, exhibit or other display assembly. The connecting frame members extend vertically intermediate adjacent panel assemblies and each provides two or more receiving channels into which jaw arrangements extending from horizontally disposed panel frame members are inserted and engaged. Each jaw arrangement includes a pair of pivotably connected jaw members between which is disposed a slide member movable toward and away from the pivot axis of the jaw members respectively for permitting their movement toward one another for insertion and removal from the associated channel and for actuating their movement apart for gripping engagement interiorly of the associated channel. Operational movement of the slide member is substantially more easily and quickly made for completing assembly and disassembly of display assemblies than are conventional apparatus of the general type which require rotational manipulation of screws.

9 Claims, 6 Drawing Figures

FIG. 2
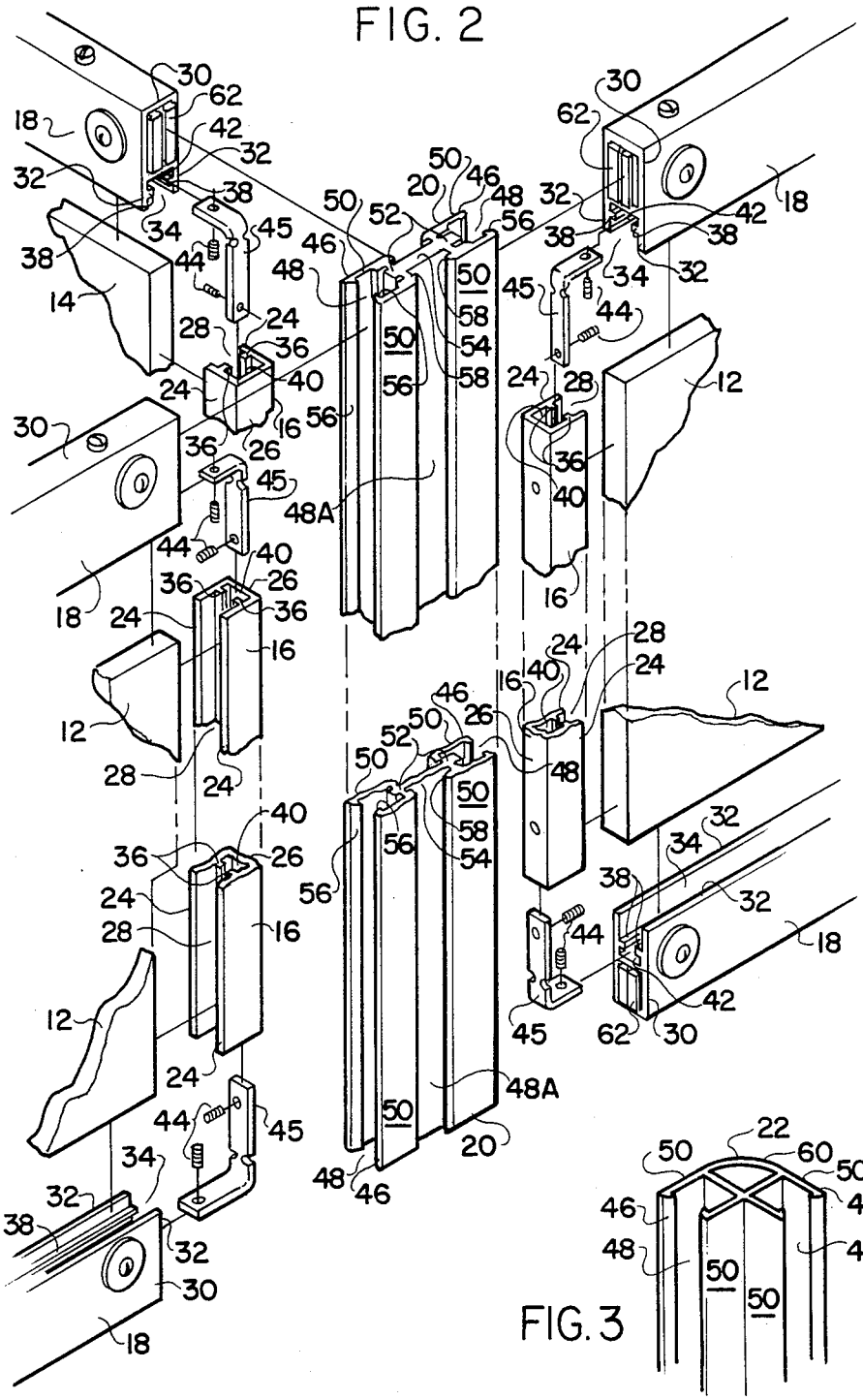
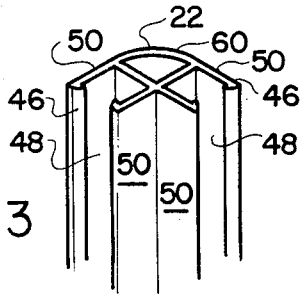
FIG. 3

DISPLAY FRAMING APPARATUS

BACKGROUND OF THE INVENTION

Various forms of modular panelized apparatus for use in constructing temporary display and like structures are known. Typically, such apparatus includes a number of sheet-like panels and compatible framing members adapted for assembling the panels in various relations to one another to provide the desired structure. This general type of modular apparatus finds greatest application in the construction of temporary booths, exhibits, showcases, partitions and like display structures and fixtures as are used at exhibitions and trade shows as well as in many retail sales establishments. Perhaps the single most important characteristic desirable in such modular structures is the capability for quick and simple assembly and disassembly so as to best facilitate their usual temporary use. While considerable effort has been devoted in the past to the designing of modular apparatus with this capability, conventional apparatus of this type utilize screws or similar means of fixing adjacent panels to one another and therefore still require a relatively considerable amount of time using appropriate hand tools for assembly and disassembly.

One conventional type of modular apparatus is manufactured by Daymond Limited, Mississauga, Canada, under the trade designation "The Daymond Modular System". Basically, this apparatus utilizes a particular system of framing members fitted about the side edges of each panel in combination with channel members adapted for connecting adjacent panels along contiguous side edges thereof. For this purpose, the frame members of each panel bordering the non-contiguous side edges are arranged to extend flush with the contiguous side edges and are respectively provided with a pair of pivoted jaw members movable toward and away from one another by an actuating screw extending through one jaw member such that the jaw members may be inserted into a channel of the respective connecting channel member and brought into interior gripping engagement therewith by appropriate operation of the actuating screw. This apparatus is not known to be disclosed in or otherwise the subject of any existing patent. This apparatus has been relatively well accepted in the trade and has met with moderately good commercial success but nevertheless is generally considered to suffer the same basic disadvantages of preceding comparable apparatus in that the apparatus offers little improvement in the ease and speed of assembly over other conventional apparatus. Specifically, in assembling and disassembling any given arrangement of panels utilizing the Daymond apparatus, it is necessary to manipulate at least four different screws in the bordering framework of each intermediate panel and at least two screws in the bordering framework or each end panel. Accordingly, in the construction of a typical booth, other enclosure, exhibit or other display of the type and size commonly used at trade shows and exhibits, the assembly and disassembly thereof may require several hours to arrange and complete. A comparable period of time would be necessary to assemble and disassemble each showcase or other store fixture of the type ordinarily employed in retail establishments, whereby a rearrangement of store floor displays may require many man hours to complete. Therefore, this apparatus still falls far short of the flexibility in use of such display framing apparatus desired and needed in the present state of this art.

SUMMARY OF THE INVENTION

In contrast, the present invention provides a significant and substantial improvement in display framing apparatus of the basic type of the above-described Daymond system. It is a primary object of the present invention to provide an assembly arrangement in such type of display framing apparatus adapted for quick and simple connection and disconnection of framing members which does not employ screws, bolts or similar fasteners and which does not require the use of any tools at all. It is another object of the present invention to provide such an improved display framing apparatus which may be substantially completed in disassembled form in advance of use for any particular desired arrangement of display panels and which will facilitate the assembly and disassembly of the arrangement at the point of use usually in a matter of minutes.

Most basically, the display framing apparatus of the present invention utilizes two types of frame members. One frame member is formed to define an outwardly opening channel thereon. The other frame member includes a pair of opposed jaw members movably arranged thereon for relative movement toward and away from one another between a released position wherein the jaw members are disposed relatively adjacent one another for insertion into and removal from the channel and an engaged position wherein the jaw members are disposed relatively spaced from one another for gripping engagement interiorly of the channel. A jaw operating member is slidably movable intermediately of the jaw members and compatably profiled therewith so as to permit the jaw members to move to their released position in a jaw releasing position of the operating member and for moving the jaw members to and maintaining them in their engaged position in a jaw engaging position of the operating member. In this manner, connection and disconnection of the frame members is accomplished rapidly and without tools essentially only by sliding movement of the jaw operating member.

In the preferred embodiment, an appropriate plurality of the second-mentioned frame member are employed for bordering certain side edges of plural display panels to be arranged in a display assembly with an appropriate plurality of the first-mentioned frame member being provided for connecting the plural panels in their desired arrangement. The second frame members are tubular and carry their jaw members and jaw operating member interiorly thereof with the jaw members extending outwardly from the ends of the tubular frame members. The jaw members of each pair thereof are pivotably connected with one another for relative pivotal movement. The associated jaw operating member is disposed between the jaw members for operating movement toward and away from the pivot axis thereof. A control member extends outwardly from the jaw operating member through aligned openings in one jaw member and in the tubular frame member for manual actuation of its operative sliding movement.

Each pair of jaw members includes opposed facing surfaces having inwardly-extending opposed engaging portions at the distal ends thereof from their pivot axis defining a spacing between the jaw members. The jaw operating member is a slide member slidably disposed between the jaw members and dimensioned to be contained substantially in the spacing therebetween in the jaw releasing position of the slide member so as to permit the engaging portions of the jaw members to move substantially together and alternatively to be engaged between the engaging portions in the jaw engaging position of the slide member to move the jaw members apart. The engaging portions of the jaw members and the slide member are compatibly tapered for cammed movement of the jaw members from their released position to their engaged position upon the aforesaid movement of the slide member.

The first frame member includes inwardly-projecting opposed lips along the opposite sides of its channel and the jaw members include outwardly-facing grooves adapted to engage with the lips.

BRIEF DESCRIPTION OF THE DRAWINGS

FIG. 2 is an exploded rear perspective view of a portion of the display assembly of FIG. 1 looking along the arrow 2 therein, illustrating the connection of frame members and their respective panels;

FIG. 3 is a perspective view of an alternate form of connecting frame member for joining adjacent panels;

DESCRIPTION OF THE PREFERRED EMBODIMENT

Figure 1:
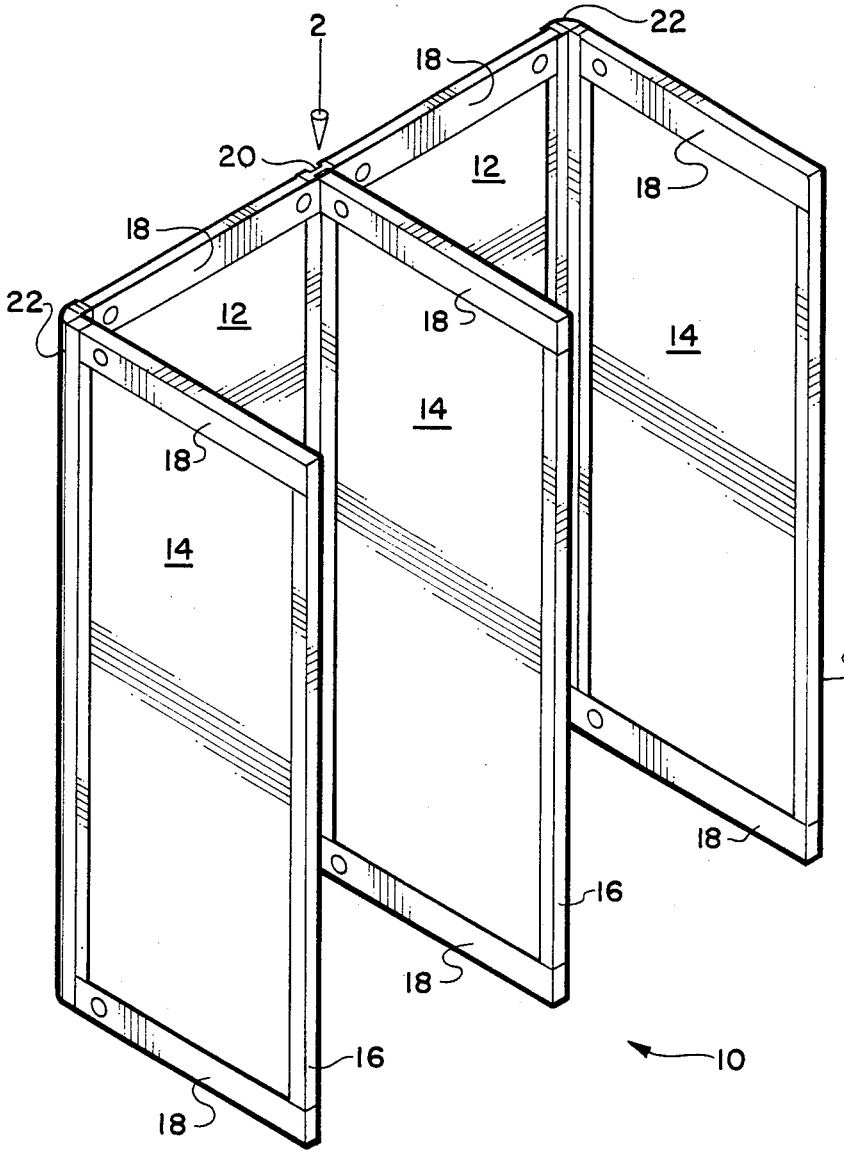
FIG. 1 is a perspective view of a display assembly constructed utilizing the display framing apparatus of the present invention.

Referring now in greater detail to the accompanying drawings, a representative display assembly of the type which ordinarily is employed as an exhibit at an exhibition or trade show is indicated generally at 10 in FIG. 1. Basically, the display assembly 10 includes five display panels 12,14 bordered and joined together in the illustrated assembly by the display framing apparatus of the present invention. Such display framing apparatus includes panel frame members 16,18 bordering each panel 12,14 along its side edges and connecting frame members 20,22 joining the assemblies of the panels 12,14 and panel frame members 16,18 in side-by-side relation along contiguous side edges thereof. For convenient shorthand reference, an assembly of a panel 12,14 with its panel frame members 16,18 will hereinafter be designated as a "panel assembly".

The panels 12,14 constitute planar sheets of generally any desired material, size, and shape. As will be understood, the panel material employed will depend upon the desired end use of the panel assembly. Typically, a lightweight material is preferred to best facilitate ease of handling of the panels 12,14 in assembly and disassembly thereof as well as in transportation and storage thereof. For this purpose, the panels 12,14 may be constructed of a styrofoam core having a decorate coating such as a fabric or the like adhered or otherwise affixed thereto. Alternatively, the panels 12,14 may be of glass, plastic or another transparent or translucent material. Preferably, the panels 12,14 are rectangular or square in shape for greater versatility and interchangeability in their use. For convenience, it is also preferred that the panels 12,14 be relatively small in size again for purposes of convenience and ease in the handling of the panels.

The panel frame members 16,18 are best seen in FIG. 2. For each panel 12,14, two panel frame members 16 and two panel frame members 18 are employed, the panel frame members 16 being arranged along the vertical side edges of the respective panel and the panel frame members 18 being arranged along the horizontal side edges thereof. Each panel frame member 16 is of a U-shaped configuration including spaced, parallel side walls 24 joined in such relation by a web portion 26 extending therebetween thereby forming a channel 28. Each panel frame member 18 includes a rectangular tubular portion 30 with integrally-formed wall portions 32 extending from one shorter side of the rectangular tubular portion 30 in coplanar relation with the larger sides thereof and thereby being in spaced parallel relation defining a channel 34. The respective channels 28,34 of the panel frame members 16,18 are configured and dimensioned to receive snuggly the respective side edges of a panel 12,14 and the respective channel defining walls 24,32 of the panel frame members 16,18 are provided with interior flanges 36,38 forming inner passageways 40,42 for receiving angular connectors 45 adapted to be secured to the panel frame members 16,18 by allen screws 44 for rigidly affixing the panel frame members 16,18 about a panel 12,14 with the vertical panel frame members 16 extending between the horizontal panel frame members 18 and with the ends of the horizontal panel frame members 18 flush with the webs 26 of the horizontal panel frame members 18, all as more fully described and illustrated in copending U.S. patent application Ser. No. 369,746, filed Apr. 19, 1982, entitled PANEL FRAME. The panel frame member 16,18 are formed respectively as integral units preferably of a relatively lightweight metal material, such as aluminum extrusions.

According to the present invention, the horizontal tubular panel frame members 18 and the connecting frame members 20,22 are constructed with compatible connecting elements adapted for quick and simple connection and disconnection of the panel assemblies and the connecting frame members 20,22. The connecting frame members 20,22 are adapted to extend vertically intermediate contiguous vertical sides of panel assemblies to be joined adjacently in side-by-side relation and are adapted to be connected with the horizontal panel frame members 18 of such panel assemblies.

Each connecting frame member 20,22 is unitarily formed such as by aluminum extrusion to be of a length corresponding to the desired height of the connected panel assemblies. Each connecting frame member 20,22 is constructed to include at least two longitudinal trackways 46 defining two or more U-shaped channels 48. Varying types of connecting frame members of this basic construction having different numbers of trackways 46 and channels 48 at varying orientations are contemplated to facilitate the connection of panel assemblies in varying desired angular relations to one another.

The connecting frame member 20, best seen in FIG. 2, is adapted for joining up to four panel assemblies in respective perpendicular "X" relation. The connecting frame member 20 includes two trackways 46 each having two parallel spaced side walls 50 with an intermediate connecting web 52, the two trackways 46 being arranged in opposed spaced outwardly opening relation with their respective webs 52 inwardly parallel and a wall 54 extending perpendicularly between the webs 52. In this manner, each of the two trackways 46 defines a channel 48 and the webs 52 and the intermediate wall 54 define two additional channels 48A. Each side wall 50 is provided on its interior surface with an inwardly projecting lip 56 extending adjacently along the outward edge of the wall 50. Similarly, the outward edges of the webs 52 are each provided with inwardly projecting lips 58.

The connecting frame member 22 is best seen in FIG. 3 and includes two longitudinal trackways 46, each including two side walls 50 and a connecting web 52, which trackways 46 are joined by a semi-cylindrical web portion 60 with their respective channels 48 opening in 90 degree relation to one another. In this manner, the connecting frame member 22 is adapted for joining two panel assemblies in perpendicular "L" relation to one another. As with the connecting frame member 20, each side wall 50 of each trackway 46 is interiorly provided with an inwardly extending lip 58 along its outward edge.

Figure 4:
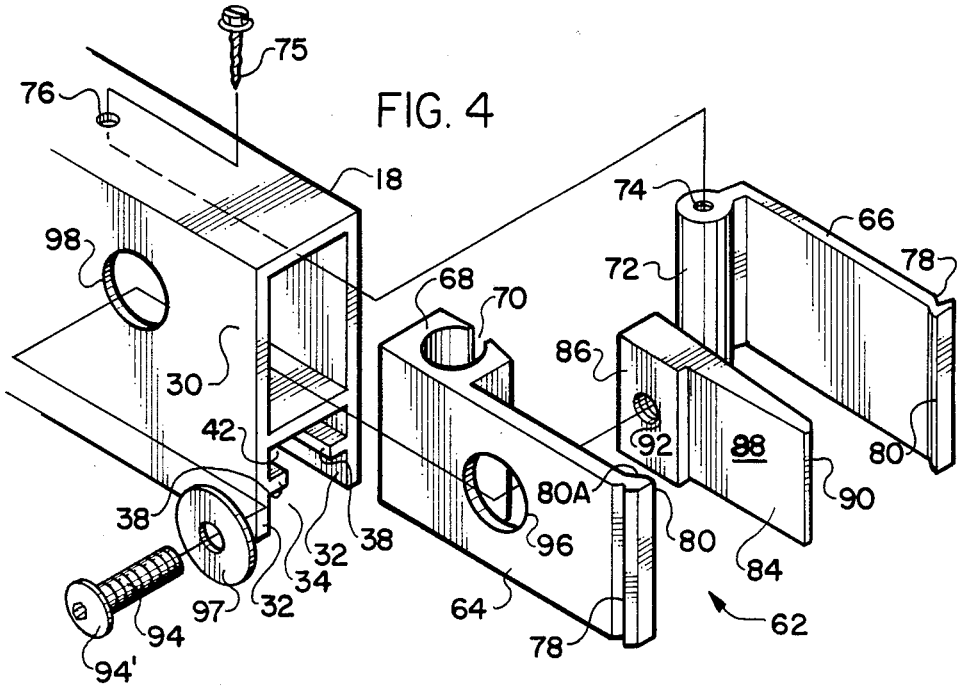
FIG. 4 is an exploded perspective view of one end of one panel frame member having pivoted jaw members.

The construction of the tubular horizontal panel frame members 18 is best understood with reference to FIG. 4 wherein one end of one such panel frame member 18 is illustrated in exploded form. A movable jaw arrangement, generally indicated at 62, is received in the tubular portion 30 of each tubular panel frame member 18 at each end thereof which is intended to be joined with a connecting frame member 20,22. Thus, for example, the tubular panel frame members 18 bordering the panels 12 of FIG. 1 would include a jaw arrangement 62 within each end of their tubular portions 30, while the tubular panel frame members 18 bordering the panel 14 of FIG. 1 would only have one jaw arrangement in the rearward end of their tubular portions 30, as viewed in FIG. 1.

Each jaw arrangement 62 includes two generally flat planar jaw members 64,66. The jaw member 64 has an enlarged base portion 68 along one end edge thereof transversely through which is formed a cylindrical recessed opening 70. The jaw member 66 has a cylindrical body portion 72 formed along one end edge thereof. The cylindrical body portion 72 of the jaw member 66 and the cylindrical recess of the jaw member 64 are compatibly configured and dimensioned for sliding receipt of the body portion 72 axially in the cylindrical recess 70 for providing pivotal assembly of the jaw members 64,66 along respective ends thereof for relative pivotal movement thereof toward and away from one another.

The jaw members 64,66 are configured and dimensioned to be slidably received lengthwise in the tubular portion 30 of a panel frame member 18. The cylindrical body portion 22 of the jaw member 66 has a threaded axial bore 74 formed in one end thereof which aligns with an opening 76 in one side wall of the tubular portion 30 of the panel frame member 18 for affixation of the pivoted assembly of the jaw members 64,66 longitudinally within an end thereof by a screw 75 with the free ends of the jaw members 64,66 extending outwardly to partially project from the open end of the tubular portion 30.

Each jaw member has a groove formed transversely across its outward surface along its projecting end, the groove 78 being shaped to receive neatly a lip 50 or 52 of a connecting frame member 20,22. The projecting ends of the jaw members 64,66 have inwardly projecting tapered engaging portion 80 adapted to restrict pivotal movement of the jaw members 64,66 toward one another so that a spacing 82 is defined between the jaw members 64,66 in their inwardly pivoted position.

A slide member 84 is received in the spacing 82 between the jaw members 64,66. The slide member 84 includes an enlarged base portion 86 from which extends toward the free ends of the jaw members 64,66 a slightly, tapered tongue portion 88 having a rounded end edge 90. A threaded bore 92 is formed through the base portion 86 of the slide member 84 and receives a threaded screw 94 which extends outwardly through aligned enlarged openings 96,98 respectively in the jaw member 64 and the adjacent side wall of the tubular portion 30 of the panel frame member 18. A washer 97 is preferably provided between the head 94' of the screw 94 and the outer surface of the tubular portion 30. Thus, it will be understood that the screw 94 permits manual actuation of sliding movement of the slide member 84 within the spacing 82 toward and away from the pivot axis between the jaw members 64,66 generally in a plane intersecting such axis by manual manipulation of the exteriorly-disposed head 94' of the screw 94.

Figure 5:
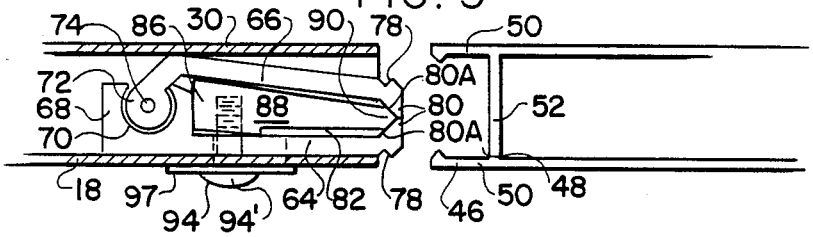
FIG. 5 is a sectional view taken longitudinally through a panel frame member of the type of FIG. 4 and transversely through a mating channel frame member showing them in disassembled condition.
Figure 6:
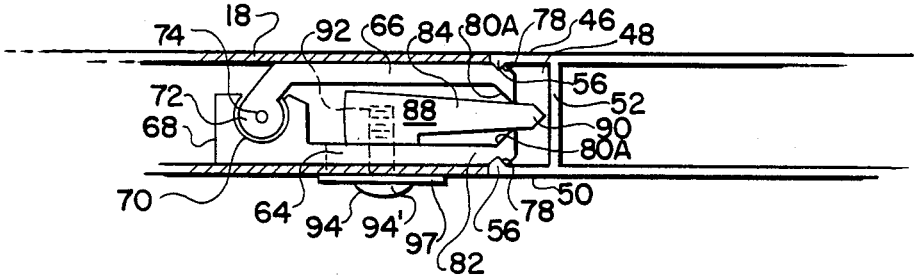
FIG. 6 is a sectional view similar to FIG. 5 showing the panel frame member and the channel frame member in assembled relation.

The slide member 84 is compatibly configured with the facing surfaces of the jaw members 64,66 and the spacing 82 therebetween and is of a longitudinal dimension for being contained substantially entirely within the spacing 82 and thereby to permit the jaw members 64,66 to pivot toward one another with their inwardly projecting engaging portions 80 substantially together. In such pivoted condition of the jaw members 64,66, herein designated as their released position, the projecting ends of the jaw members 64,66 are of a sufficiently small overall dimension in the arc of their pivotal movement so as to be adapted to be readily moved into and out of any channel 48 of a connecting frame member 20,22 (see FIG. 5). Upon actuation of sliding movement of the slide member 84 outwardly of the tubular portion 30 of the tubular panel frame member 18, the rounded end edge 90 of the tongue portion 88 of the slide member 84 is caused to engage the tapered surfaces 80A of the engaging portions 80 of the jaw members 64,66 and to move therebetween causing cammed movement of the jaw members 64,66 apart. The thickness and the tapered nature of the tongue portion 88 is such that this described sliding movement thereof causes the jaw members 64,66 to move apart to a sufficient extent for grippingly engaging snuggly the interior wall surfaces of the side walls 50 of a channel 48 with the lips 56 or 58 thereof engaged in the grooves 78 of the jaw members 64,66. This outwardly pivoted condition of the jaw members 64,66 is herein designated as their engaged position.

The operation of the present invention for assembly and disassembly of the connecting frame members 20,22 and associated panel assemblies will thus be understood. The connection of any panel assembly with any connecting frame member 20,22 requires only the manual arrangement of one selected channel 48 of the connecting frame member 20,22 and one selected vertical side of the panel assembly is adjacent facing relation, the manual manipulation thereof to effect insertion into the channel of the jaw arrangements 62 in the ends of the tubular panel frame members 18 at such side of the panel assembly while in their released position, and the manual manipulation of the screw head 94' of the jaw arrangements 62 to cause sliding movement of the slide members 84 thereof outwardly between the jaw members 64,66 thereof to move them into their engaged positions gripping the interior wall surfaces of the side walls 50 defining the channel 48. Similarly, the disassembly of any panel assembly from any connecting frame member 20,22 to which it has been so connected requires only the manual manipulation of the screw heads 94' in a reverse fashion to move their associated slide members 84 fully inwardly within the spacings 82 between their associated jaw members 64,66 to permit the jaw members 64,66 to pivot inwardly to their released position which in turn permits manual separation of the connecting frame member 20,22 and the associated panel frame members 18 of the panel assembly.

The advantages of the present invention also will thus be understood. For any given display assembly, such as the assembly 10 of FIG. 1, the constituent panel assemblies of individual panels 12,14 and their bordering panel frame members 16,18 may be constructed and preassembled in advance of the intended use of the display assembly without haste as time permits and requires. Similarly, the necessary connecting frame members 20,22 may be prepared in advance. The preassembled panel assemblies and preselected connecting frame members 20,22 may then be readily stored and transported in their thusly prepared, disassembled form for later assembly at the desired place and time of use, e.g., a trade show or exhibition. The assembly of each panel assembly with its preselected associated connecting frame member or members 20,22 in the above-described fashion requires only a matter of seconds, whereby the structure of a relatively large display assembly may readily and easily be erected by one or two persons in a matter of minutes. Should movement or rearrangement of the display assembly be desirable or required during the course of its use, such changes may readily be made with only minimal interruption of the display. The disassembly of the display assembly and readying thereof for storage and/or transportation may similarly be quickly and simply completed. Notably, no tools of any sort are required for the assembly and disassembly of the present invention, except of course in the preassembling of the panel assemblies. These advantages of the present invention are to be contrasted with prior art display framing apparatus such as the aforementioned Daymond Modular System which requires the use of a screwdriver for completing the connection and disconnection of each associated jaw arrangement and connecting frame member of the system. In light of the fact that even relatively simple display assemblies employing display framing apparatus of the basic type of the present invention and the Daymond system will ordinarily require a relatively large number of individual connections of this sort, it will be readily understood that the present invention facilitates assembly and disassembly of such apparatus in a mere fraction of the time which would be required for assembly and disassembly of the same display assembly employing the Daymond system.

The present invention has been described in detail above for purposes of illustration only and is not intended to be limited by this description or otherwise to exclude any variation or equivalent arrangement that would be apparent from, or reasonably suggested by the foregoing disclosure to the skill of the art.

I claim:

1. A display framing apparatus for repeated temporary uses comprising two frame members and assembly means for quick connection and disconnection of said frame members, said assembly means including means on one said frame member defining an outwardly opening channel, means defining an interior cavity in the other frame member at one end thereof, a pair of opposed jaw members arranged within said interior cavity in said other said frame member and having respective engaging end portions extending outwardly from said open end of said other frame member, said jaw members being pivotally connected to one other at a spacing from their end portions for relative pivotal movement thereof toward and away from one another between a released position wherein said end portions of said jaw members are disposed relatively adjacent one another for insertion into and removal from said channel and an engaged position wherein said end portions of said jaw members are disposed relatively spaced from one another for gripping engagement interiorly of said channel defining means, said jaw members having opposed facing surfaces which are compatibly configured to define an operating area between said jaw members, a jaw operating member slidably disposed in said area and compatibly profiled with said facing surfaces of said jaw members for sliding movement of said jaw operating member in said area toward and away from the pivot axis of said jaw members between a jaw releasing position wherein said jaw operating member is substantially contained within said operating area for permitting said end portions of said jaw members to move substantially together to their said released position and a jaw engaging position wherein said jaw operating member extends outwardly between said engaging portions of said jaw members in wedged engagement therewith for moving said end portions of jaw members to and for maintaining them in their said engaged position, said other frame member having an opening therethrough adjacent said interior cavity therein, and a control member affixed integrally to said jaw operating member for unitary sliding movement therewith toward and away from the pivot axis of said jaw members, said control member extending outwardly through said opening to the exterior of said other frame member and said opening being of an enlarged dimension relative to said control member for permitting selective manual movement of said control member in said opening toward and away from the pivot axis of said jaw members to actuate corresponding unitary sliding movement of said jaw operating member between its said jaw releasing and jaw engaging positions, whereby connection and disconnection of said frame members is accomplished rapidly and without tools essentially only by manual sliding movement of said control member.

2. A display framing apparatus according to claim 1 and characterized further in that said operating area between said jaw members and said jaw operating member are compatibly tapered for cammed movement of said jaw members from their said released position to their said engaged position upon movement of said jaw operating member from said jaw releasing position to said jaw engaging position.

3. A display framing apparatus according to claim 1 and characterized further in that said channel defining means includes inwardly-projecting opposed lips along opposite sides of said channel and said engaging end portions of said jaw members includes outwardly-facing grooves adapted to engage with said lips.

4. A display framing apparatus according to claim 1 and characterized further by a display panel framework, said framework including said other frame member, and a connecting frame member for adjoining said display panel framework with a like display panel framework, said connecting frame member including said one frame member.

5. A display framing apparatus according to claim 1 and characterized further in that one said jaw member has an enlarged opening therethrough aligned with said enlarged opening in said other frame member, said control member extending through and movable in each of said aligned enlarged openings.

6. A display framing apparatus for repeated temporary uses comprising a plurality of prefabricated display panel frameworks for side-by-side connection to form a display apparatus and a plurality of connecting frame members for connecting respective sides of said frameworks, each connecting frame member defining plural outwardly opening channels, and each said framework including a pair of tubular frame members extending transversely of a selected side of said framework, a pair of opposed jaw members arranged within the end of each said tubular frame member at said selected side, each said pair of jaw members having respective engaging end portions extending outwardly from said end of the respective said tubular frame members with said jaw members being pivotally connected to one another at a spacing from their end portions for relative pivotal movement thereof toward and away from one another between a released position wherein said end portions of said jaw members are disposed relatively adjacent one another for insertion into and removal from one said channel of one connecting frame member and an engaged position wherein said end portions of said jaw members are disposed relatively spaced from one another for gripping engagement of said one connecting frame member interiorly of its said channel, each said pair of jaw members having opposed facing surfaces which are compatibly configured to define an operating area between said jaw members, a jaw operating member slidably disposed in said area of each said pair of jaw members and compatibly profiled with said facing surfaces of said jaw members for sliding movement of said jaw operating member in said area toward and away from the pivot axis of said jaw members between a jaw releasing position wherein said jaw operating member is substantially contained within said operating area for permitting said end portions of said jaw members to move substantially together to their said released position and a jaw engaging position wherein said jaw operating member extends outwardly between said engaging portions of said jaw members in wedged engagement therewith for moving said end portions of said jaw members to and for maintaining them in their said engaged position, each said tubular frame member having an opening therethrough at said end thereof at said selected side, and a control member affixed integrally to each said jaw operating member for unitary sliding movement therewith toward and away from the pivot axis of the respective said pair of jaw members, each said control member extending outwardly through said opening in the respective said tubular frame member to the exterior thereof and each said opening being of an enlarged dimension relative to the respective said control member for permitting selective manual movement of said control member in said opening toward and away from the pivot axis of the respective said pair of jaw members to actuate corresponding unitary sliding movement of the respective said jaw operating member between its said jaw releasing and jaw engaging positions, whereby connection and disconnection of said frameworks and said connecting frame members are accomplished rapidly and without tools essentially only by manual sliding movement of said control members.

7. A display framing apparatus according to claim 6 and characterized further in that said operating area between each said pair of jaw members and their said jaw operating member are compatibly tapered for cammed movement of said jaw members from their said released position to their said engaged position upon movement of said jaw operating member from said jaw releasing position to said jaw engaging position.

8. A display framing apparatus according to claim 7 and characterized further in that said channel defining means includes inwardly-projecting opposed lips along opposite sides of said channel and said engaging end portions of each said pair of jaw members includes outwardly-facing grooves adapted to engage with said lips.

9. A display framing apparatus according to claim 6 and characterized further in that one jaw member of each said pair of jaw members has an enlarged opening therethrough aligned with said enlarged opening in the respective said tubular frame member, said control member extending through and being movable in each of said aligned enlarged openings.

* * * * *